US010197350B2

(12) United States Patent
Kauffman

(10) Patent No.: US 10,197,350 B2
(45) Date of Patent: Feb. 5, 2019

(54) REMOTELY AUTHORIZING AND DISABLING WEAPONS

(71) Applicant: Morgan Draper Kauffman, Houston, TX (US)

(72) Inventor: Morgan Draper Kauffman, Houston, TX (US)

( * ) Notice: Subject to any disclaimer, the term of this patent is extended or adjusted under 35 U.S.C. 154(b) by 430 days.

(21) Appl. No.: 14/291,088

(22) Filed: May 30, 2014

(65) Prior Publication Data

US 2015/0345884 A1 Dec. 3, 2015

(51) Int. Cl.
*F41A 17/06* (2006.01)

(52) U.S. Cl.
CPC ..... *F41A 17/063* (2013.01)

(58) Field of Classification Search
CPC ..... F41A 17/00; F41A 17/06; F41A 17/20; F41A 17/46; F41A 17/163; F41A 17/066
USPC ..... 42/70.01–70.11
See application file for complete search history.

(56) References Cited

U.S. PATENT DOCUMENTS 3,888,181 A 6/1975 Kups
4,003,152 A * 1/1977 Barker et al. ..... 42/70.01
5,062,232 A * 11/1991 Eppler ..... 42/70.11
5,461,812 A * 10/1995 Bennett ..... 42/70.11
5,796,362 A 8/1998 Ayasli
5,915,936 A * 6/1999 Brentzel ..... 42/70.11
5,937,557 A * 8/1999 Bowker et al. ..... 42/70.01
5,953,844 A * 9/1999 Harling et al. ..... 42/70.06
6,014,932 A 1/2000 Mardirossian
6,223,461 B1 * 5/2001 Mardirossian ..... 42/70.11
6,226,913 B1 * 5/2001 Haimovich et al. ..... 42/1.01
6,237,271 B1 * 5/2001 Kaminski ..... 42/70.06
6,283,034 B1 * 9/2001 Miles, Jr. ..... 102/430
6,487,804 B1 * 12/2002 Petrella, Jr. ..... 42/70.11
6,823,621 B2 * 11/2004 Gotfried ..... 42/70.06
6,860,206 B1 3/2005 Rudakevych
7,319,397 B2 1/2008 Chung
7,423,535 B2 9/2008 Chung
7,441,362 B1 * 10/2008 Kley ..... 42/70.01
7,669,054 B2 2/2010 Fox
7,848,905 B2 12/2010 Troxler
7,921,588 B2 * 4/2011 Brown et al. ..... 42/70.01
8,086,351 B2 12/2011 Gaudiano
8,183,983 B2 5/2012 Friedrich
8,312,660 B1 * 11/2012 Fujisaki ..... 42/70.11
8,375,838 B2 2/2013 Rudakevych
2002/0112390 A1 * 8/2002 Harling et al. ..... 42/70.11
2002/0170220 A1 * 11/2002 Recce ..... 42/70.08
2003/0097776 A1 * 5/2003 Brosow ..... 42/70.01
2003/0110972 A1 6/2003 Porter
2004/0031180 A1 * 2/2004 Ivanov ..... 42/70.11
2006/0242879 A1 * 11/2006 Schmitter ..... 42/70.01
2007/0241010 A1 * 10/2007 Giebel et al. ..... 206/317
(Continued)

*Primary Examiner* — Jonathan C Weber
(74) *Attorney, Agent, or Firm* — Cantor Colburn LLP

(57) ABSTRACT

A weapon, a method of authorizing the weapon and weapon security system are disclosed. An authorization string is stored at the weapon. An authorization message may be received at the weapon from an authorization center. A processor at the weapon may obtain a first substring from the authorization message, the first substring being obtained from a copy of the authorization string. The processor compares the first substring to a second substring and authorizes the weapon when the first substring matches the second substring.

18 Claims, 7 Drawing Sheets

(56) References Cited

U.S. PATENT DOCUMENTS

| | | | | |
|---|---|---|---|---|
| 2008/0032268 | A1* | 2/2008 | Farrell et al. | 434/16 |
| 2009/0007476 | A1* | 1/2009 | Mauch et al. | 42/1.01 |
| 2009/0223104 | A1* | 9/2009 | Anzeloni | 42/70.06 |
| 2009/0255160 | A1* | 10/2009 | Summers | 42/70.01 |
| 2010/0070107 | A1 | 3/2010 | Berkobin | |
| 2011/0063138 | A1 | 3/2011 | Berkobin | |
| 2012/0109417 | A1 | 5/2012 | Berkobin | |
| 2014/0290109 | A1* | 10/2014 | Stewart et al. | 42/70.01 |
| 2014/0290110 | A1* | 10/2014 | Stewart et al. | 42/70.11 |
| 2014/0360073 | A1* | 12/2014 | Stewart et al. | 42/70.11 |

* cited by examiner

REMOTELY AUTHORIZING AND DISABLING WEAPONS

BACKGROUND

The present invention relates to weapons security, and more specifically, to a system and method for authorizing or de-authorizing a weapon remotely.

In times of war, with two warring parties attempting to cause destruction and death to the each other, it is possible for weapons from a first party to be captured or otherwise obtained by a second party. These captured weapons may then be used against the first party, the very party that brought them into the field of battle, or against other parties. The impact of losing these weapons to the second party can therefore result in lost lives to the first party or its allies and can sway an outcome of a battle or skirmish or provide the means for terror attacks elsewhere. Considering another situation, a first party may supply weapons to a second party, which sells the weapons to a third party, which then uses the weapons against a fourth party. Thus, the present method of proliferating arms may have unintended consequences. Therefore weapons security, or the ability to prevent such weapons from being used counter to their intended purposes, is an important aspect of warfare.

SUMMARY

In one aspect, the present disclosure provides a method of authorizing a weapon, including: storing an authorization string at the weapon; receiving an authorization message at the weapon that includes a first substring obtained from a copy of the authorization string; comparing the first substring to a second substring obtained from the authorization string stored at the weapon; and authorizing the weapon when the first substring matches the second substring.

In another aspect, the present disclosure provides a weapon, the weapon including: a memory configured to store an authorization string; a receiver configured to receive a first substring obtained from a copy of the authorization string; and a processor configured to: obtain a second substring from the authorization string stored in memory, compare the first substring to the second substring, and authorize the weapon when the first substring matches the second substring.

In another aspect, the present disclosure provides a weapon security system, the system including: an authorization center that transmits an authorization message that includes a first substring obtained from a copy of an authorization string; and a weapon that includes: a memory configured to store the authorization string; a receiver configured to receive the authorization message; and a processor configured to: obtain the first substring from the received authorization message; obtain a second substring from the authorization string stored in memory, compare the first substring to the second substring, and authorize the weapon when the first substring matches the second substring.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

Figure 1:
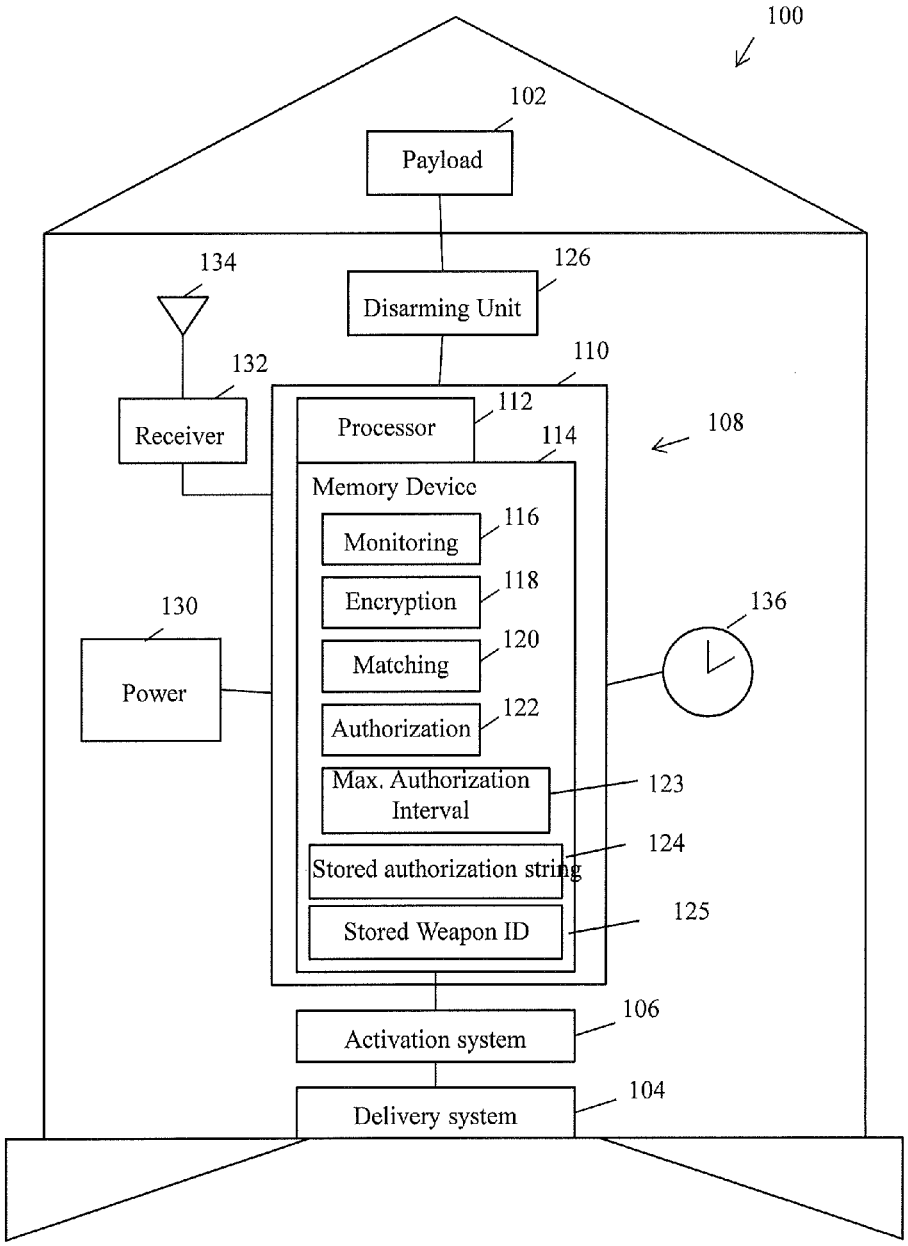
FIG. 1 illustrates an exemplary weapon 100 in one embodiment of the present invention.

FIG. 1 illustrates an exemplary weapon 100 in one embodiment of the present invention. The weapon in various embodiments may include a gun, a missile, an explosive, etc. The weapon 100 may include a payload 102 and a payload delivery system 104. The weapon 100 may further include an activation system 106 that activates the delivery system 104 to delivery the payload 102. In one example, the weapon 100 may be a missile such that the payload 102 is an explosive material, generally at a forward location of the weapon 100, and the delivery system 104 is a propellant generally ejected from an aft location of the weapon 100. The activation system 106 may be a trigger mechanism, switch or an electronic signal that activates the delivery system 104. The activation system 106 may be coupled mechanically or electronically to an authorization unit 108. The authorization unit 108 may be used to enable (authorize) or disable (de-authorize) the activation system 106 and thus enable or disable the weapon 100 by determining an authorization state of the weapon 100 using the methods disclosed herein. In other words, the authorization unit 108 places the weapon 100 into either an authorized state or an unauthorized state. In the authorized state, the weapon 100 is armed and can be fired, detonated, or otherwise used. In the unauthorized state, the weapon 100 is essentially harmless and may be prevented from being fired, detonated, or otherwise used. In one example, the authorization unit 108 may prevent the activation system 106 from activating the delivery system 104. In another example, the authorization unit 108 may perform an action, such as sending a "disarm" signal to a disarming unit 126 that disarms the payload.

The authorization unit 108 may include a control unit 110 for performing various methods disclosed herein for placing the weapon 100 into either the authorized state or the unauthorized state. The control unit 110 may include a processor 112 that performs the various methods and processes described herein. The processor 112 may have access to a memory device 114 that may include various programs 116, 118, 120, 122 stored therein which, when accessed by the processor 112, enable the processor 112 to perform the various methods for selecting or determining the authorization state of the weapon 100. The memory device 114 may be any non-transitory computer-readable medium such as a solid-state memory device. In various embodiments, the memory device 114 may include a read-only memory (ROM), a programmable read-only memory (PROM), or other suitable memory type.

The memory device 114 may further contain an encoded string of bits, also referred to as a stored authorization string or first authorization string 124 that is used when determining the authorization state of the weapon 100. The memory device 114 also stores a weapon identification 125 (also referred to herein as a weapon ID or WID) that identifies the weapon 100. The weapon ID 125 may be unique to the weapon 100 or may be an identification number or code that is uniquely assigned to a group of weapons, so that the entire group of weapons may be responsive to the same weapon ID 125. The memory device 114 also stores a maximum authorization interval 123 that determines the maximum period of time that may elapse since the last authorization without causing the weapon to be disabled.

The authorization unit 108 also includes various additional components that ensure the operation of the authorization unit 108. These components include a power supply 130, a receiver 132 and its associated antenna 134, and a clock 136. Power supply 130 provides power to the control unit 110, processor 112, receiver 132, clock 136 and any other electrical components used in the authorization and/or deployment of the weapon 100. Receiver 132 and antenna 134 may be suitable for communication over any selected radio frequency or other selected frequency of the electromagnetic spectrum. Clock 136 may be an internal digital clock or any suitable type of clock for maintaining time to a suitable degree of accuracy. For the purposes of authorizing/de-authorizing the weapon 100, clock 136 keeps a count of elapsed time since the weapon has been issued and/or since the most recent completed authorization. Whenever the weapon 100 is re-issued or re-authorized, the elapsed time stored in the clock 136 may be reset to t=0, or the time of authorization may be stored in such a way as to allow calculation of elapsed time from the time at which the weapon is re-issued or most recently re-authorized. When the time between receiving authorization messages exceed the maximum authorization interval, the weapon may be automatically disabled. Issuance of the weapon is discussed below with respect to FIG. 3. Upon issue of the weapon 100, the activation time of the clock 136 is stored at an authorization center, as discussed below with respect to FIG. 2.

Referring further to FIG. 1, the memory device 114 of the weapon 100 may contain, among other programs, a monitoring program 116, an encryption/decryption program 118, a matching program 120 and an authorization program 122. The processor 112 may run these programs 116, 118, 120 and 122 to determine an authorization state of the weapon 100. The monitoring program 116 includes a set of instructions that cause the receiver 132 to listen continuously or periodically at a designated interval for radio frequency messages transmitted on a specified frequency or set of frequencies and to identify and record a transmitted authorization message (see FIG. 5, 512) when a weapon ID in the authorization message matches a stored weapon ID 125 that is stored in the memory device 114 of the particular weapon 100.

Once the weapon 100 receives an authorization message and is authorized, if the clock 136 counts to a selected value K before the monitoring program 116 receives a next authorization signal, the weapon 100 will shut down or de-authorize. Whenever a weapon 100 is issued, its weapon ID 125 is stored in its memory 114 and its internal clock 136 starts to count from an assigned or selected start time. In one embodiment, the assigned start time may be selected to be represented by t=0. However, the assigned start time may be any recorded time, such as an issue time, a re-issue time, an authorization time, a re-authorization time or other time suitable for the purposes described herein. Every time the weapon re-authorizes, the clock is reset to a new assigned start time and begins its count from the new assigned start time.

In another embodiment, the monitoring program 116 may have access to the clock 136 and activate the receiver 132 periodically to listen for the transmitted authorization message at an end of a selected time interval as indicated by the clock 136. The selected time interval may be, for example, 12 hours, 24 hours, 30 minutes, etc. Listening periodically may be used in order to preserve battery life.

The encryption/decryption program 118 includes a set of instructions that obtains the authorization message and obtains a first substring or first encrypted substring from the authorization message. The encryption/decryption program 118 may then obtain a second substring from the stored authorization string 124. The encryption/decryption program 118 may use a conversion formula or encryption formula that provides a "one-way" conversion or encryption to obtain a second encrypted substring from the second substring. A "one-way" conversion formula may be a formula that can be performed easily and/or in a relatively short amount of time, but for which the inverse of the conversion formula is difficult or time-intensive to perform.

The matching program 120 includes a set of instructions that compares the first substring to the second substring. The authorization program 122 includes a set of instructions that select an authorization state of the weapon 100 based on the results of the matching program 120. In one embodiment, the authorization program 122 prevents the arming and/or firing of the weapon 100 when the matching program 122 does not register a match between the received message and stored data. In another embodiment, the authorization program 122 prevents the arming and/or firing of the weapon 100 when the interval since last authorization (stored in the clock 136) exceeds the maximum authorization interval 123. Methods for authorizing the weapon are discussed below with respect to FIGS. 5 and 6.

Figure 2:
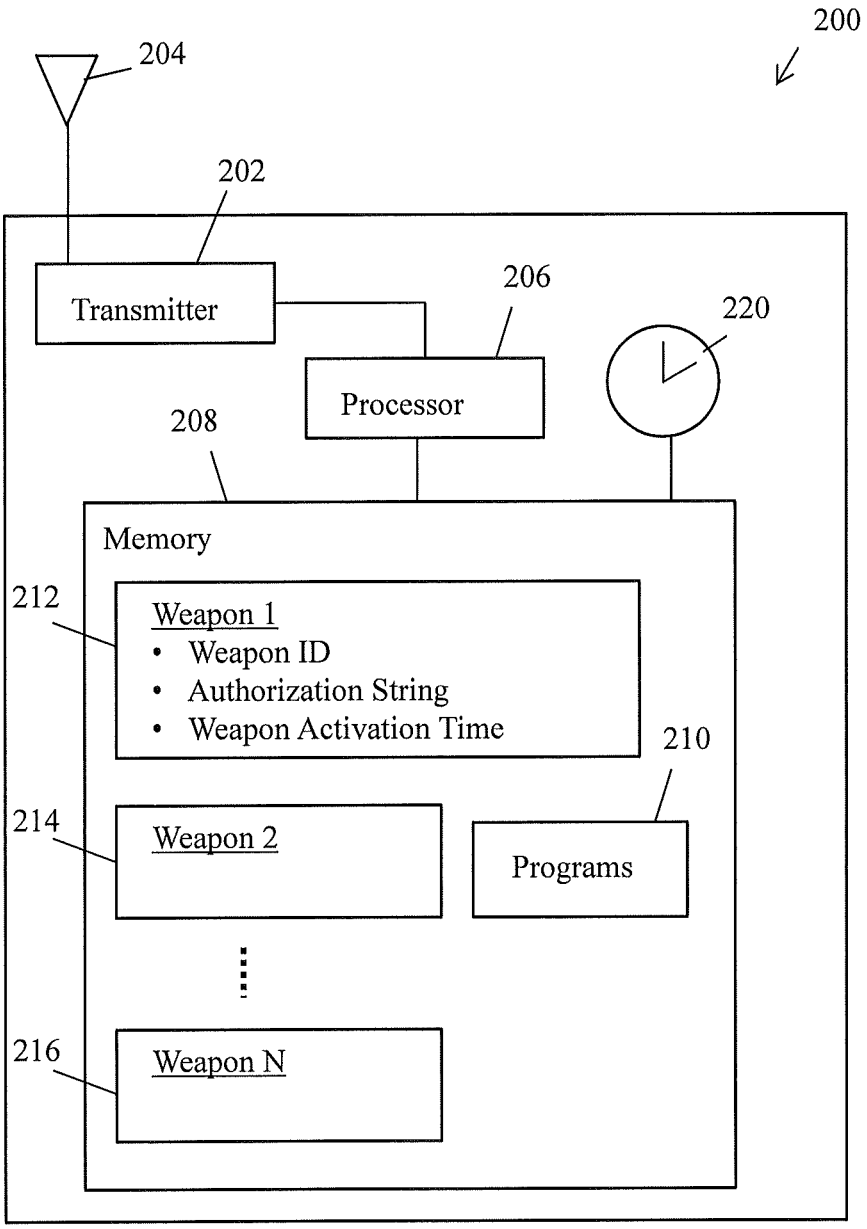
FIG. 2 shows an exemplary authorization center that communicates with the exemplary weapon of FIG. 1 in order to place the weapon into a selected authorization state.

Referring now to FIG. 2, FIG. 2 shows an exemplary authorization center 200 that communicates with the exemplary weapon 100 of FIG. 1 in order to place the weapon 100 into a selected authorization state. The authorization center 200 includes one or more transmitters 202 and associated antenna(s) 204 for transmitting an authorization message to the weapon 100. The authorization center 200 further includes a processor 206 having access to a memory device 208 and various programs 210 stored therein that when accessed by the processor 206, enable the processor 206 to transmit a selected authorization message to one or more weapons. The memory device 208 may have a database or various memory locations 212, 214, 216 containing data that may be transmitted to a selected weapon for authorization purposes. An exemplary memory location 212 may include a weapon ID, as well as an authorization string and an activation time of the weapon 100. The memory device 208 may be any non-transitory computer-readable medium such as a solid-state memory device, read-only memory (ROM), programmable read-only memory (PROM), etc.

Figure 3:
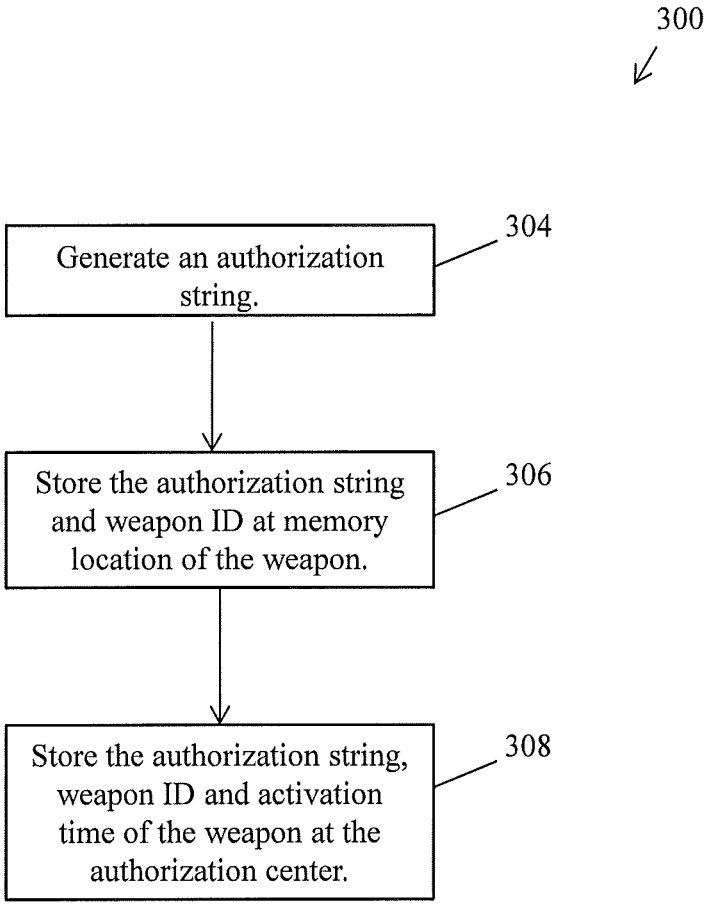
FIG. 3 shows a flowchart illustrating a method of initializing the weapon.

FIG. 3 shows a flowchart 300 illustrating a method of initializing weapon 100. The method shown in flowchart 300 prepares the authorization center (200, FIG. 2) and the weapon (100, FIG. 1) so that the authorization method disclosed herein may be executed. Prior to issuing the weapon 100, a computer or other device generates a random string of bits, referred to herein as an authorization string (Box 302). In various embodiments, this authorization string is generally a large string, such as greater than 1 gigabyte. In box 304, the authorization string 124 and the weapon ID 125 of the weapon 100 is stored at the memory device 114 of the weapon 100. In box 306, when the weapon 100 is issued, the authorization string, weapon ID and activation time is stored at the memory device 208 of the authorization center 200, such as at memory location 212. The clock 136 of the weapon 100 records the activation time using an initiation signal at the authorization center 200. Any interlocks and/or anti-tampering devices and/or programs that prevent the weapon 100 from being altered, analyzed, interrogated, reprogrammed, or disassembled by unauthorized personnel may then be applied.

Figure 4:
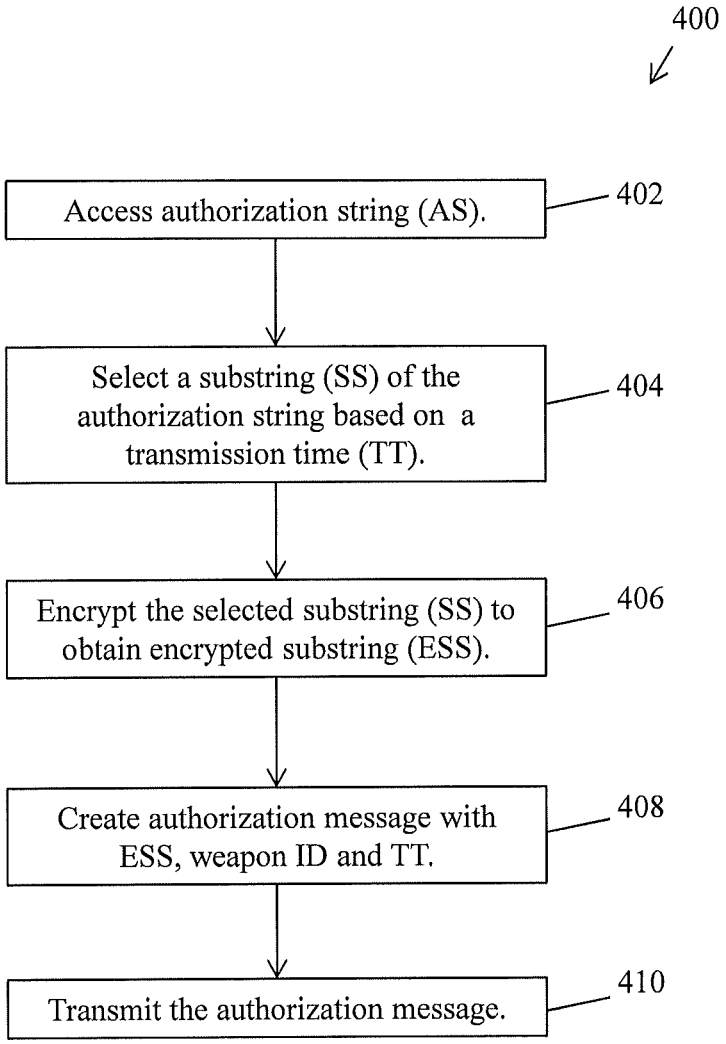
FIG. 4 shows a flowchart illustrating a process for sending an authorization message from the authorization center to a weapon in the field, in one embodiment.
Figure 5:
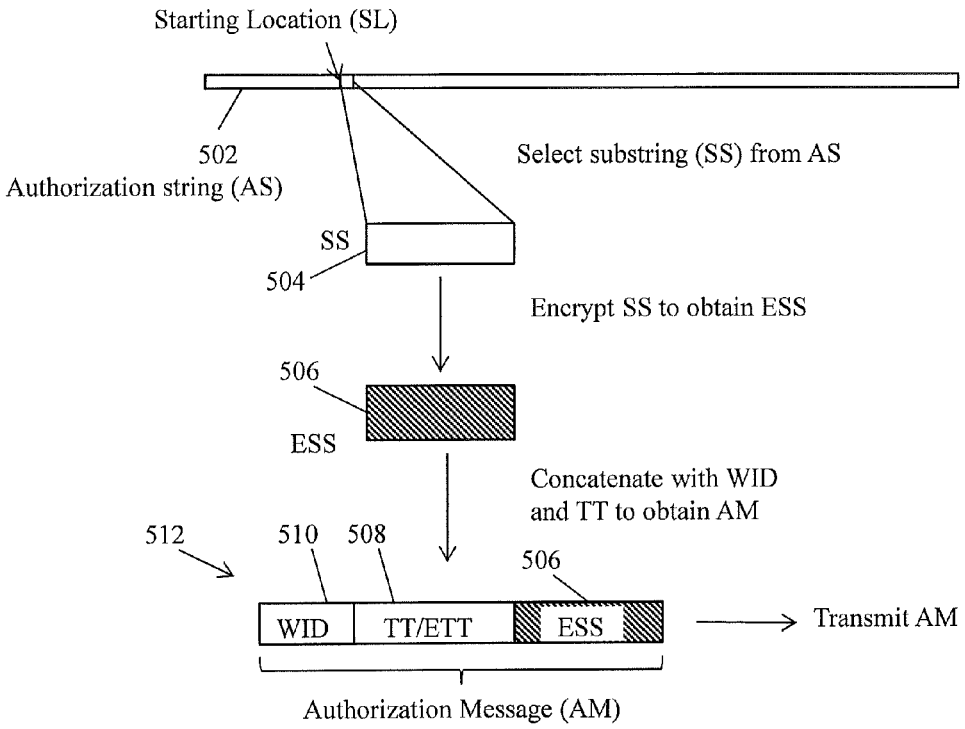
FIG. 5 schematically illustrates the method described in the flowchart of FIG. 4.

FIG. 4 shows a flowchart 400 illustrating a process for sending an authorization message from the authorization center 200 to a weapon 100 in the field, in one embodiment. FIG. 5 schematically illustrates the method described in the flowchart 400 of FIG. 4. Referring to FIGS. 4 and 5, in Box 402, an authorization string 502 is obtained or accessed. The authorization string 502 is generally the authorization string that is stored at the authorization center 200 of FIG. 2. In Box 404, a first substring (SS) 504 is selected from the authorization string 502 based on a selected transmission time of an authorization message. Each authorization message 502 has one or more associated time slots (also referred to herein as transmission time (TT)) for transmitting the authorization message 502.

Figure 6:
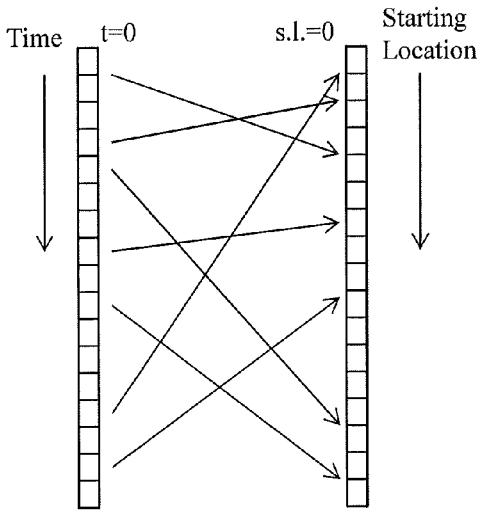
FIG. 6 shows an example of a transformation method which determines a starting location from the transmission time.

The first substring 504 may be obtained using a hashing algorithm or other suitable transformation algorithm. In one embodiment, the hashing algorithm is used to transform the transmission time into a starting location (SL) in the authorization string. FIG. 6 shows an example of a transformation method which determines a starting location from the transmission time. For illustrative purposes, time is shown in time array 602 and increases in a downward direction on the page. The authorization string 604 is shown having a plurality of bit locations, where the numbering of the bit locations increase in a downward direction on the page. Arrows 606 indicate the effects of applying transformation algorithm to select the SL for a selected TT. The transformation may be a non-sequential transformation. For example, a scheduled first TT may be transformed to obtain an SL of 9797, while a second TT that is scheduled for five seconds after the first TT may be transformed to obtain an SL of 183, which is less than 9797.

Referring back to FIGS. 4 and 5, in Box 406 the first substring 504 is encrypted to obtain a first encrypted substring (ESS) 506. In box 408, the first ESS 506, TT 508, and the weapon ID 510 are concatenated to each other or otherwise combined to obtain an authorization message 512. In another embodiment, the transmission time (TT) may be encrypted to obtain encrypted transmission time (ETT). The authorization message 512 may then include the first ESS 506, the ETT 508 and the weapon ID 510. In box 410, the authorization message 512 is transmitted to the weapon 100.

Figure 7:
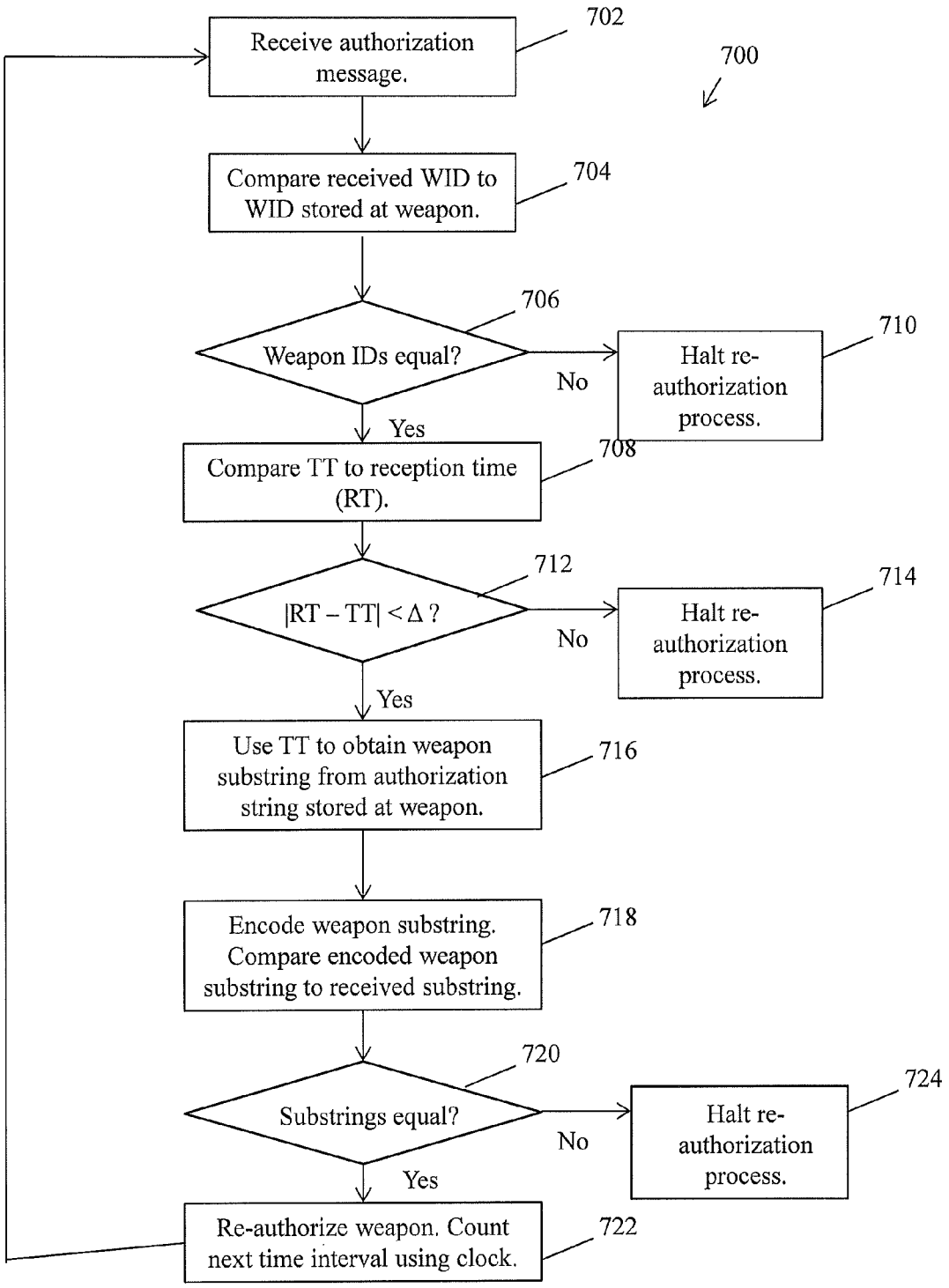
FIG. 7 shows a flowchart illustrating an exemplary process performed at the weapon for authorizing the weapon in an embodiment of the present disclosure.
Figure 8:
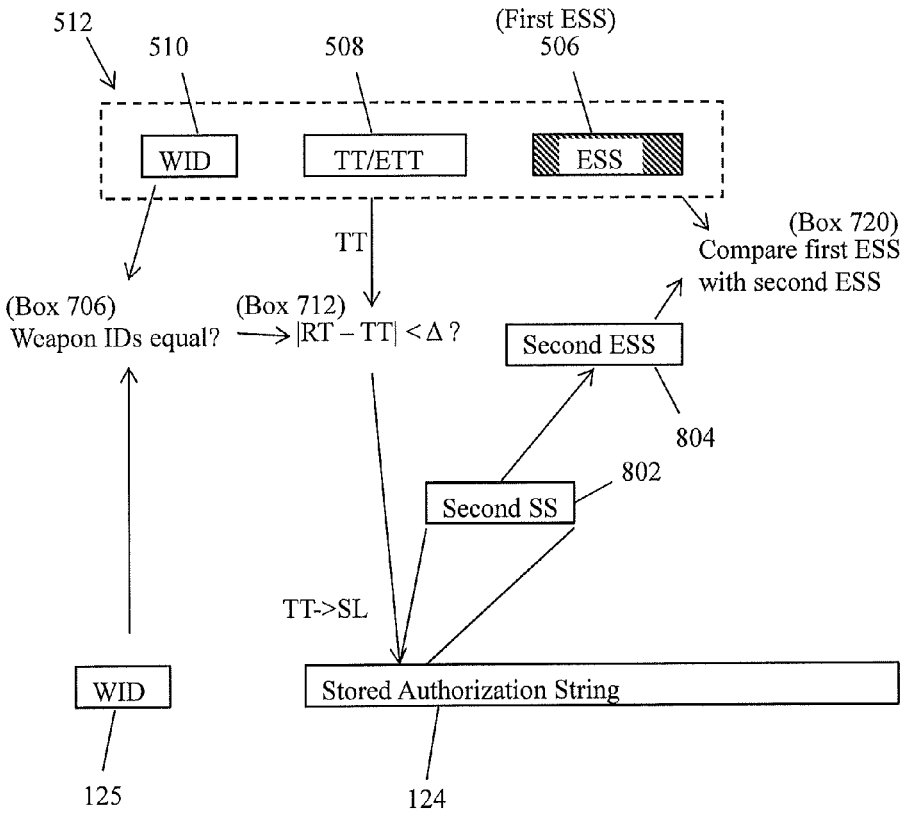
FIG. 8 shows a schematic illustration of the processes illustrated in the flowchart of FIG. 7.

FIG. 7 shows a flowchart 700 illustrating an exemplary process performed at the weapon 100 for authorizing the weapon in an embodiment of the present disclosure. Once issued, the weapon periodically performs this process to either maintain or alter its authorization state. FIG. 8 shows a schematic illustration of the processes illustrated in the flowchart of FIG. 7. In Box 702, the processor 112 operates the monitoring program 116 to receive a transmitted authorization message 502 from the authorization center 200. In Box 704, the processor 112 compares the weapon ID 510 included in the authorization message 512 with the weapon ID 125 stored at the weapon 100. In Box 706, if the weapon ID 510 matches the stored weapon ID 125, the process proceeds to Box 708. Otherwise, the process proceeds to Box 710, in which the weapon is disabled or de-authorized.

In Box 708, TT 508 is obtained from the authorization message 512. If an encrypted transmission time (ETT) has been sent in the authorization message, encryption/decryption program 118 may be performed on the ETT to obtain its corresponding TT 508. The obtained TT 508 is then compared to a reception time (RT) of the message. The reception time may be determined from the clock 136 of the weapon 100. If the difference between TT and RT is less than a selected time threshold $\Delta$ (e.g., $\Delta$=3 seconds) then the method proceeds to Box 716. Otherwise, the method proceeds to Box 718 at which point the attempt to re-authorize the weapon is discontinued.

In Box 716, the TT 508 received via transmission of the authorization message 512 is used to obtain a second substring 702 from the authorization string 124. The same hashing algorithm that is used to select a starting location for the first substring at the authorization center 200 may be used to select the starting location of the second substring at the weapon 100. Proceeding to Box 718, the processor 112 runs an encryption algorithm on the second substring 802 to obtain a second encrypted substring 804. The second encrypted substring 804 is then compared to the received (first) ESS 506. In Box 720, if the encrypted substrings 804 and 506 are equal, the process proceeds to Box 722. If the encrypted substrings 804 and 506 are not equal, the process proceeds to Box 724 at which point the attempt to re-authorize the weapon is discontinued. The substrings are compared bitwise so that a successful match is indicated when first substring and second substring (or first ESS 506 and second ESS 804) match exactly bit-for-bit. In Box 722, the processor 112 maintains or places the weapon 100 into an authorized state. From Box 722, the processor 112 may start the monitoring program 116 again at Box 702 so as to be able to run the authorization process again at the end of the next time interval.

The weapon 100 is therefore in an authorized state only temporarily, i.e., until a time at which a next authorization signal is expected to be received. At some point at or prior to the end of this time interval, the authorization state must be renewed by the methods disclosed herein or the weapon will be disabled or de-authorized. Therefore, a default state of the weapon 100 is an unauthorized or disabled state.

The amount of time between receiving a valid authorization message and disabling the weapon may be selected to be greater than the product of the number of weapon IDs and the time required to transmit one authorization message, so that weapons may be maintained in an authorized state in a given theater of operation. As an example, let K=the number of seconds since receiving a valid authorization message before a weapon becomes disabled, N=the maximum number of weapon IDs being issued using a same frequency or transmission system in a selected theater of operation, and L=the length of time needed or allotted to transmit a single authorization message, including any buffering time that may be required between messages. Therefore, $K>N*L$ in order for all weapons in the theater to maintain their authorization state given normal authorization operations. For example, if it takes 1 second to transmit an authorization message and there are 10,000 unique weapon IDs in the theater of operation assigned to the same frequency or group of frequencies, K will need to be greater than 10,000 seconds (about 2.8 hours). Otherwise, a weapon may de-authorize before its next authorization message is even transmitted. Having the weapon listen continuously for the authorization message may allow authorization messages to be sent more frequently than necessary, providing redundancy and increased reliability If weapon IDs are assigned to groups of weapons in a theater of operation, the number of unique weapon IDs may be less than the number of weapons in the theater. For example, by assigning weapon IDs to groups, 1200 unique IDs may be used rather than 10,000 unique IDs. This may allow authorization messages to be transmitted more frequently than necessary, thereby reducing the probability that a weapon misses an authorization message and disables or de-authorizes the weapon inadvertently. Therefore, in the above scenario, one may transmit each of the weapons' authorization messages in a non-stop loop that is 20 minutes in duration, rather than using a non-stop loop that is 10,000 seconds (about 2.8 hours) in duration.

The time interval between authorization messages may be set at a duration that is appropriate to the circumstances in which the weapon 100 is being issued. For example, a 12-hour authorization interval or a daily authorization interval may allow a weapon 100 to be used in a local theater of operations, but still prevent the weapon 100 from being shipped any considerable distance. Alternatively, a short authorization time interval may be chosen, with the option that several re-authorizations may be missed in sequence before the weapon is disabled or de-authorized. This allows the weapon 100 to remain authorized in the face of issues that may arise that may cause authorization messages to occasionally be missed, such as jamming, static, accidental shielding, etc.

The weapon 100 may additionally be de-authorized by stopping or interrupting the timed authorization messages. This therefore results in a "dead man's switch" in which the destruction or interruption of the authorization center 200 or of its transmitter 202 causes the weapon 100 to be de-authorized by default. The dead man's switch prevents, for example, an opposing army or force from capturing the weapon and then blocking or otherwise interfering with a de-authorization message.

While the invention is described with respect to artillery, weapons and weaponry, the method of authorizing and de-authorizing may also be used in other devices and/or systems not specifically disclosed herein.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated The flow diagrams depicted herein are just one example. There may be many variations to this diagram or the steps (or operations) described therein without departing from the spirit of the invention. For instance, the steps may be performed in a differing order or steps may be added, deleted, or modified. All of these variations are considered a part of the claimed invention.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. A method of authorizing a weapon, comprising:

storing an authorization string at the weapon;

receiving an authorization message at the weapon that includes a first substring obtained from a copy of the authorization string;

comparing the first substring to a second substring obtained from the authorization string stored at the weapon;

authorizing the weapon when the first substring matches the second substring;

de-authorizing and thereby disabling the weapon when the weapon is not re-authorized within a selected time interval; wherein the received authorization message includes receiving a transmission time of the authorization message, and using the received transmission time to obtain the second substring from the authorization string stored at the weapon.

2. The method of claim 1, wherein comparing the first substring to the second substring further comprises encrypting the first substring to obtain a first encrypted substring, encrypting the second substring to obtain a second encrypted substring, and comparing the first encrypted substring to the second encrypted substring.

3. The method of claim 2, further comprising using the transmission time to determine a starting location for selecting the first substring from the copy and to determine a starting location for selecting the second substring the stored authorization string.

4. The method of claim 1, further comprising authorizing the weapon when:

(i) the weapon obtains the authorization message before the end of a selected time interval;

(ii) the weapon identification associated with the authorization message matches a weapon identification stored at the weapon;

(iii) a difference between a reception time of the authorization message and a transmission time of the authorization message is less than a selected time threshold; and (iv) the first encrypted substring matches the second encrypted substring.

5. The method of claim 1, wherein the authorization message includes an encrypted transmission time, the method further comprising decrypting the transmission time at the weapon.

6. The method of claim 1 wherein the weapon shares a weapon identification with one or more additional weapons and the weapon and the one or more additional weapons are authorized using a same authorization message.

7. A weapon, comprising:

a memory configured to store an authorization string;

a receiver configured to receive a first substring obtained from a copy of the authorization string; and a processor configured to:

obtain a second substring from the authorization string stored in memory, compare the first substring to the second substring, authorize the weapon when the first substring matches the second substring;

de-authorize and thereby disable the weapon when the weapon is not re-authorized within a selected time interval; wherein the received authorization message includes receiving a transmission time of the authorization message; and use the received transmission time to obtain the second substring from the authorization string stored at the weapon.

8. The weapon of claim 7, wherein the processor is further configured to receive first encrypted substring corresponding to the first substring, select and encrypt the second substring to obtain a second encrypted substring, and compare the first encrypted substring to the second encrypted substring.

9. The weapon of claim 7, wherein the transmission time is further configured to obtain a starting location for selecting the first substring from the copy of the authorization string.

10. The weapon of claim 7, wherein the processor is further configured to authorize the weapon when:

(i) the weapon obtains the authorization message before the end of a selected time interval;

(ii) the weapon identification associated with the authorization message matches a weapon identification stored at the weapon;

(iii) a difference between a reception time of the authorization message and a transmission time of the authorization message is less than a selected time threshold; and (iv) the first encrypted substring matches the second encrypted substring.

11. The weapon of claim 7, wherein the processor is further configured to decrypt an encrypted transmission time included in the received authorization message.

12. The weapon of claim 7, wherein a weapon identification of the weapon is the same as a weapon identification of one or more additional weapons and the processor authorizes the weapon use the same authorization message used to authorized the one or more additional weapons.

13. A weapon security system, comprising:

an authorization center that transmits an authorization message that includes a first substring obtained from a copy of an authorization string; and a weapon that includes:

a memory configured to store the authorization string;

a receiver configured to receive the authorization message; and a processor configured to:

obtain the first substring from the received authorization message;

obtain a second substring from the authorization string stored in memory, compare the first substring to the second substring, authorize the weapon when the first substring matches the second substring; and de-authorize and thereby disable the weapon when the weapon is not re-authorized within a selected time interval; wherein the received authorization message includes receiving a transmission time of the authorization message; and use the received transmission time to obtain the second substring from the authorization string stored at the weapon.

14. The weapon security system of claim 13, wherein the processor is further configured to receive first encrypted substring corresponding to the first substring, encrypt the second substring to obtain a second encrypted substring, and compare the first encrypted substring to the second encrypted substring.

15. The weapon security system of claim 13, wherein the processor is further configured to disarm the weapon when the weapon does not receive a valid authorization message by the end of the selected time interval.

16. The weapon security system of claim 13, wherein the processor is configured to decrypt an encrypted transmission time included in the received authorization message to obtain the transmission time of the authorization message at the weapon.

17. The weapon security system of claim 13, wherein the processor is configured to authorize the weapon when:

(i) the weapon obtains the authorization message before the end of a selected time interval;

(ii) the weapon identification associated with the authorization message matches a weapon identification stored at the weapon;

(iii) a difference between a reception time of the authorization message and a transmission time of the authorization message is less than a selected time threshold; and (iv) the first encrypted substring matches the second encrypted substring.

18. The weapon security system of claim 13, further comprising a plurality of weapons having a same weapon identification, wherein the authorization center transmits the authorization message to the plurality of weapons to authorize the plurality of weapons as a group.

* * * * *